US006210117B1

(12) United States Patent
Bucher et al.

(10) Patent No.: US 6,210,117 B1
(45) Date of Patent: Apr. 3, 2001

(54) DEVICE FOR CONNECTING A FAN BLADE TO A ROTOR OF A CEILING FAN MOTOR

(75) Inventors: Charles E. Bucher, Valrico; John C. Bucher; Shih-Tza Wu, both of Ft. Lauderdale, all of FL (US)

(73) Assignee: King of Fans, Inc., Ft. Lauderdale, FL (US)

( * ) Notice: Subject to any disclaimer, the term of this patent is extended or adjusted under 35 U.S.C. 154(b) by 0 days.

(21) Appl. No.: 09/390,098

(22) Filed: Sep. 3, 1999

(51) Int. Cl.[7] ..... F04D 29/64
(52) U.S. Cl. ..... 416/210 R
(58) Field of Search ..... 416/134 R, 204 R, 416/210 R, 214 R

(56) References Cited

U.S. PATENT DOCUMENTS

| | | | | |
|---|---|---|---|---|
| 2,771,259 | | 11/1956 | Laystrom . | |
| 2,965,180 | | 12/1960 | Killam . | |
| 4,050,771 | | 9/1977 | Watson . | |
| 4,121,495 | | 10/1978 | Malo . | |
| 4,511,310 | | 4/1985 | Pearce | 416/134 R |
| 4,850,799 | * | 7/1989 | Bucher, Sr. et al. | 416/134 R |
| 5,180,284 | | 1/1993 | Monrose, III et al. . | |
| 5,397,206 | | 3/1995 | Sihon . | |
| 5,462,412 | | 10/1995 | Scofield . | |
| 5,542,819 | * | 8/1996 | Bucher et al. | 416/210 R X |
| 5,873,701 | | 2/1999 | Shiu | 416/205 |
| 5,927,945 | | 7/1999 | Chen . | |
| 5,944,486 | | 8/1999 | Hodgkins, Jr. . | |
| 5,944,487 | | 8/1999 | Pearce . | |
| 5,951,197 | | 9/1999 | Wu . | |

(List continued on next page.)

FOREIGN PATENT DOCUMENTS 2 276 219 9/1994 (GB) .

*Primary Examiner*—John E. Ryznic
(74) *Attorney, Agent, or Firm*—Brian S. Steinberger; Law Offices of Brian S. Steinberger

(57) ABSTRACT

Captive fasteners and alignment posts for allowing ceiling fan blade arms to be easily and safely mounted onto ceiling mounted motors. Fasteners such as Philips head screws, regular head screws and bolts can be held captive in place on blade mounting arms with rubber grommet type washers. The grommet type washers have portions that can be sandwiched between the fastener head and the mounting arms and sandwiched between the mounting arms and rotating member on the ceiling fan motor in order to reduce vibration noise and movement Alternatively, novel captive fasteners having a thicker neck portion between a threaded end a the bead can be positioned within the grommet type washers. A second embodiment of the captive fastener is floatingly supported within the mounting arm between the fastener head and a ledge within the mounting arm through-hole, with an enlarged threaded end of the fastener on the opposite side of the ledge. A tip portion of these captive fasteners can remain extended from the upper surface of the mounting arm and is used to guide the fasteners to the mateable threaded openings on the bottom of the rotating member on the motor. A third embodiment incorporates at least one alignment post and mateable receiving hole for allowing the mounting arm to be properly aligned with the correct position on the rotating member. The alignment posts can be tapered, rounded or having flat sides such as squares and hexagons, to further position and hold the mounting arms to the rotating members on the motor. The alignment post(s) can be located on the upper surface of the mounting arms or extend downward from the rotating member of the motor. With the alignment posts either or both captive fasteners or regular fasteners such as bolts, regular head and Philips head screws can be used. Additionally, the alignment post(s) can be used without the grommet shaped washers. The alignment members and captive fasteners eliminate wobble effects by evenly attaching the mounting blade arm to the ceiling fan motor.

20 Claims, 6 Drawing Sheets

U.S. PATENT DOCUMENTS

| | | | |
|---|---|---|---|
| 5,954,449 | 9/1999 | Wu | 416/206 X |
| 5,980,353 | 11/1999 | Wu . | |
| 6,010,306 | 1/2000 | Bucher et al. | 416/210 R |
| 6,027,309 | 2/2000 | Rawls . | |
| 6,027,310 | 2/2000 | Kerr . | |
| 6,039,540 | 3/2000 | Wu | 416/210 |
| 6,095,753 | 8/2000 | Hsu . | |
| 6,139,276 * | 10/2000 | Blateri et al. | 416/210 R |

* cited by examiner

DEVICE FOR CONNECTING A FAN BLADE TO A ROTOR OF A CEILING FAN MOTOR

This invention relates to ceiling fans, and in particular to devices for easily connecting blade mounting arms to the rotors on ceiling fan motors using captive fasteners and alignment posts.

BACKGROUND AND PRIOR ART

FIG. 1 shows a partial side view of a conventional ceiling fan unit 1 that encompasses a general prior art ceiling fan system. In FIG. 1, ceiling fan motor 10 has a rotor component 20 that rotates about a central axis beneath motor 10, which is in turn connected to a housing 5 that is attached beneath a ceiling 2. A plurality of fan blades 30 are connected to the rotor 20 by mounting arms 40. Each mounting arm 40 has one end 42 connected to an end 32 of each fan blade 30, and a second end 44 having at least two through-holes 45 therethrough, so that conventional fasteners such as screws 50 pass through the through-holes 45 to mateably thread into threaded holes 25 in the bottom of rotor 20.

Usually most conventional directions have the installer first connect and hang the motor 10, rotor 20 and housing 5 to a ceiling. More often than not the installer is usually perched on a stool or ladder. Next, many directions have the installer attach the fan blades 30 to their respective mounting arms 40. Finally, one of the last steps is to connect the blade 30 and respective mounting arm 40 to the rotor 20 on the motor.

To finish this final assembly step takes great dexterity, patience, balance and time. In order for a single person 60 to be able to complete this final step, the installer 60 needs to hold in one hand 62 the fan blade 30 and already attached mounting arm 40, and to position a screw driver 70 to the heads of screws 50 with the other hand 64. The installer must be able to balance the mounting screws 50 on the tip of the screw driver 70, insert the screws upwardly though the holes 44 in the mounting arm, making sure not to accidentally drop the screws 50 and then screw the screws 50 into the mating holes 25 on the rotor 20 all while still holding the blade 30 and arm 40.

This assembly requires the installer to have to constantly hold both hands 62 and 64 raised high above their head, while again standing on a stool or ladder.

Many problems occur from this traditional method of having one person installing a ceiling fan. Screws 50 can and do accidentally fall and become lost causing more time and more expense to finish the installation. The installer 60 often has to constantly re position the blade 30 and arm 40 in order to be able to properly line up the through-holes 42 in the mounting arms 40 with their respective mating holes 25 in the bottom of rotor 20. The blade 30 and mounting arm 40 have been known to fall on and cause injury to the user 60 during assembly. Additionally, the user can lose their balance and injure themselves as well falling off the ladder and stool. Additional problems also occur after installation. For example, uneven tightening of each of the plural fasteners that connect the mounting arm to the motor has resulted in wobble effects when the ceiling fan system is running. Thus, the current operation of assembly has become known as a frustrating, undesirable, difficult, tedious, time consuming and sometimes dangerous task.

To merely add a second worker to help in the assembly installation may solve some of the problems above, but would add additional cost and labor expense to the installation project.

SUMMARY OF THE INVENTION

The first objective of the present invention is to provide a device to allow a single user to safely and easily attach a fan blade mounting arm to a ceiling mounted fan motor.

The second object of this invention is to provide a device for attaching a fan blade mounting arm to a ceiling fan motor that eliminates losing fasteners such as screws.

The third object of this invention is to provide a device for attaching a fan blade mounting arm to a ceiling fan motor by holding fasteners captive in the blade mounting arm.

The fourth object of this invention is to provide a device for guiding a fan blade mounting arm onto a ceiling mounted motor.

The fifth object of this invention is to provide a device for aligning a fan blade mounting arm to a ceiling fan mounted motor.

The sixth object of this invention is to evenly attach all the fasteners that connect a ceiling fan blade to a ceiling mounted motor to eliminate wobble effects when running the ceiling fan.

A first preferred embodiment of the novel invention device for attaching ceiling fan mounting arms to ceiling fan motors using fasteners held captive on the mounting arms, includes a ceiling fan motor having a rotating member such as a rotor endshield where the motor and rotating member have already been hung from a ceiling. A fan blade is connected to one end of a mounting arm with a second end having a captive fastener therein with a threaded end, and means such as a screw driver and the like for screwing the threaded end of the captive fastener into a mateable opening on the rotating member. The captive fastener can be the combination of a rubber type washer pre-installed within an opening in the second end of the mounting arm, and a portion of the fastener held within the opening by the washer. The fastener can have a head and a shaft, the shaft having a threaded end and an enlarged base portion between the threaded end and the head of the fastener, where the neck portion is held captive within the washer. The enlarged base portion allows plural fasteners to be evenly tightened when attaching the mounting arm to the motor. Even tightening of all the fasteners eliminates known wobbling problems when the ceiling fan is running. The washer can be a deformable member such as but not limited to a grommet shape with a first portion sandwiched between a bottom of the mounting arm and a second portion sandwiched between the rotating member and a top of the mounting arm in order to reduce any vibration noise and movement between the rotating member of the fan motor, the mounting arm and the blade. Alternately, fasteners can be held captive within the mounting arm without using separate deformable member inserts. The interior surface walls of the through-holes in the mounting arm can be narrow enough to just be able to hold captive a fastener therein. For example, the interior surface can be tapered, roughened, include protruding portions, and the like, all of which can be part of the same material that makes up the blade mounting arm. Mounting blade arms with this type of captive fastener can be made of materials such as but not limited to plastic, wood, and the like.

A second embodiment of the captive fastener has a fastener held captive in a floating position in the mounting arm through-hole. A head of the fastener can be to one side of a ledge in a through-hole within the mounting arm. The threaded end of the fastener can have a larger diameter than a narrow neck portion of the fastener so that the neck portion is located between the fastener head and the threaded end, and the threaded end being positioned to a second side of the ledge opposite the first side. The narrow neck of the fastener can move upward and downward a selected distance about the ledge. A tip portion of the fastener can protrude through an upper side of the mounting arm for guiding the mounting arm to the mateable opening on the rotating member. The heads of the captive fasteners in both the first and second embodiment can be like a regular headed screw, a Philips head screw and a bolt. An optional spring locking washer can help lock the tightened fastener in place.

When assembling both the first and second embodiments, the ceiling fan motor housing and rotating member (endshield) can usually first be hung from a ceiling. Next the installer can simply hold the pre-connected mounting arm and fan blade with one hand and guide the mounting arm until the tip portion of the captive fastener enters into the mateable threaded opening on the rotating member. With the other hand, the installer can tread the fastener into the threaded opening on the rotating member.

The third embodiment of the invention includes an alignment post and a mateable opening for receiving the alignment post, for allowing the mounting arm to be correctly aligned in position onto the rotating member. The post can extend upward from the mounting arm with a mateable receiving opening on the bottom of the rotating member. Alternatively, the alignment post can extend downward from the rotating member with the receiving opening on the mounting arm. The post can have tapered length with rounded sides so that pushing the post into the receiving opening snugly connects the mounting arm to the rotating member on the ceiling fan motor. Another version of the post has flat side portions such as those found in a square, rectangle, hexagon and the like, with the receiving opening having like configurations, thus creating a fixed position for connecting the mounting arm to the rotating member. Another version includes a second alignment post and a second mateable opening for receiving the second alignment post. With two alignment posts, only one captive fastener needs to be used Still another version allows the alignment posts to be used with existing non captive fasteners, such as but not limited to regular and Philips head screws, bolts, and the like. The novel alignment posts also eliminate known wobbling effects since the posts allow the mounting arms to be evenly attached to the motor.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

FIRST EMBODIMENT

Figure 1:
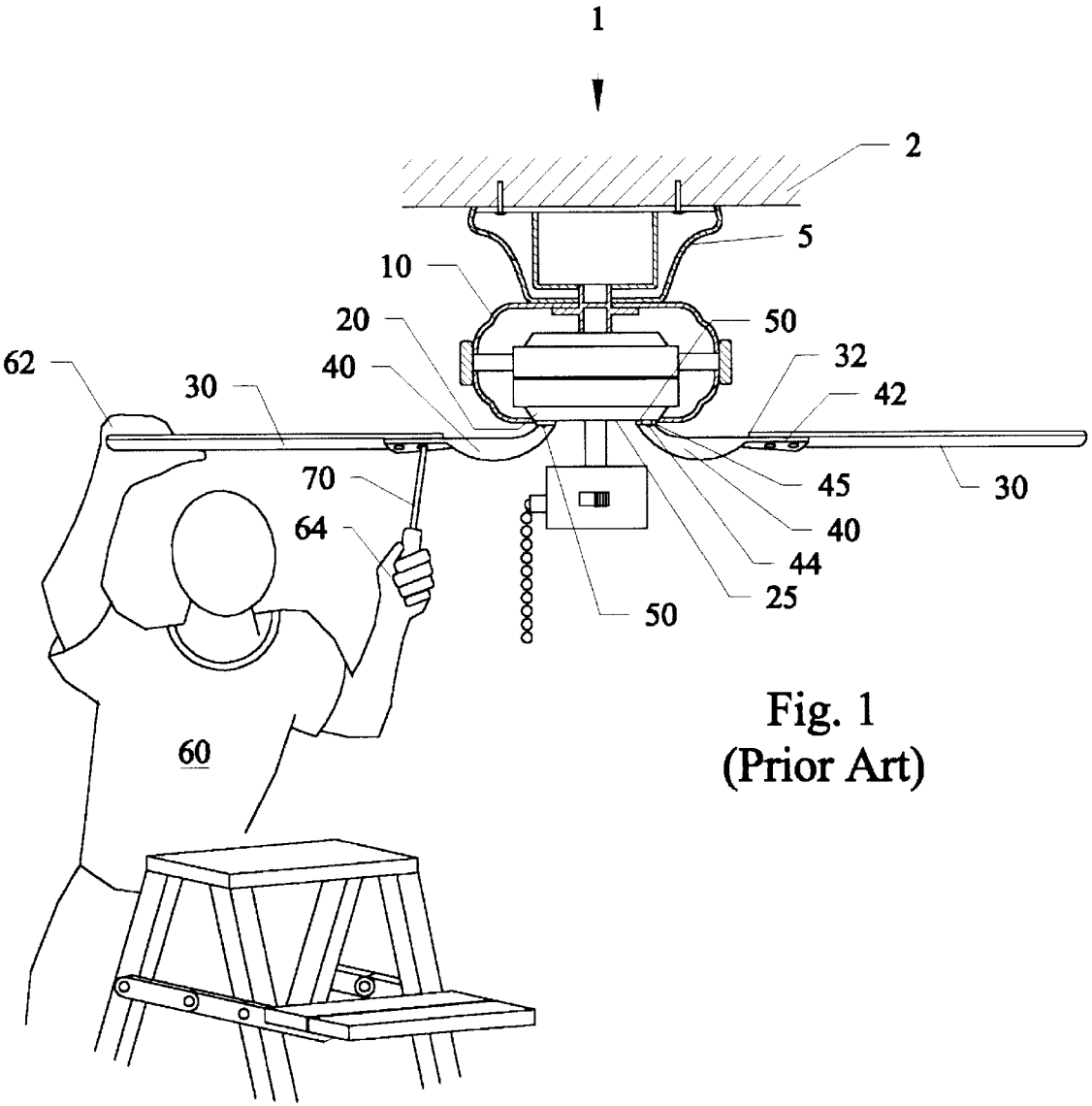
Fig. 1 (Prior Art)
FIG. 1 shows a prior art view of a blade with mounting arm attached to ceiling fan motor and rotor.
Figure 2A:
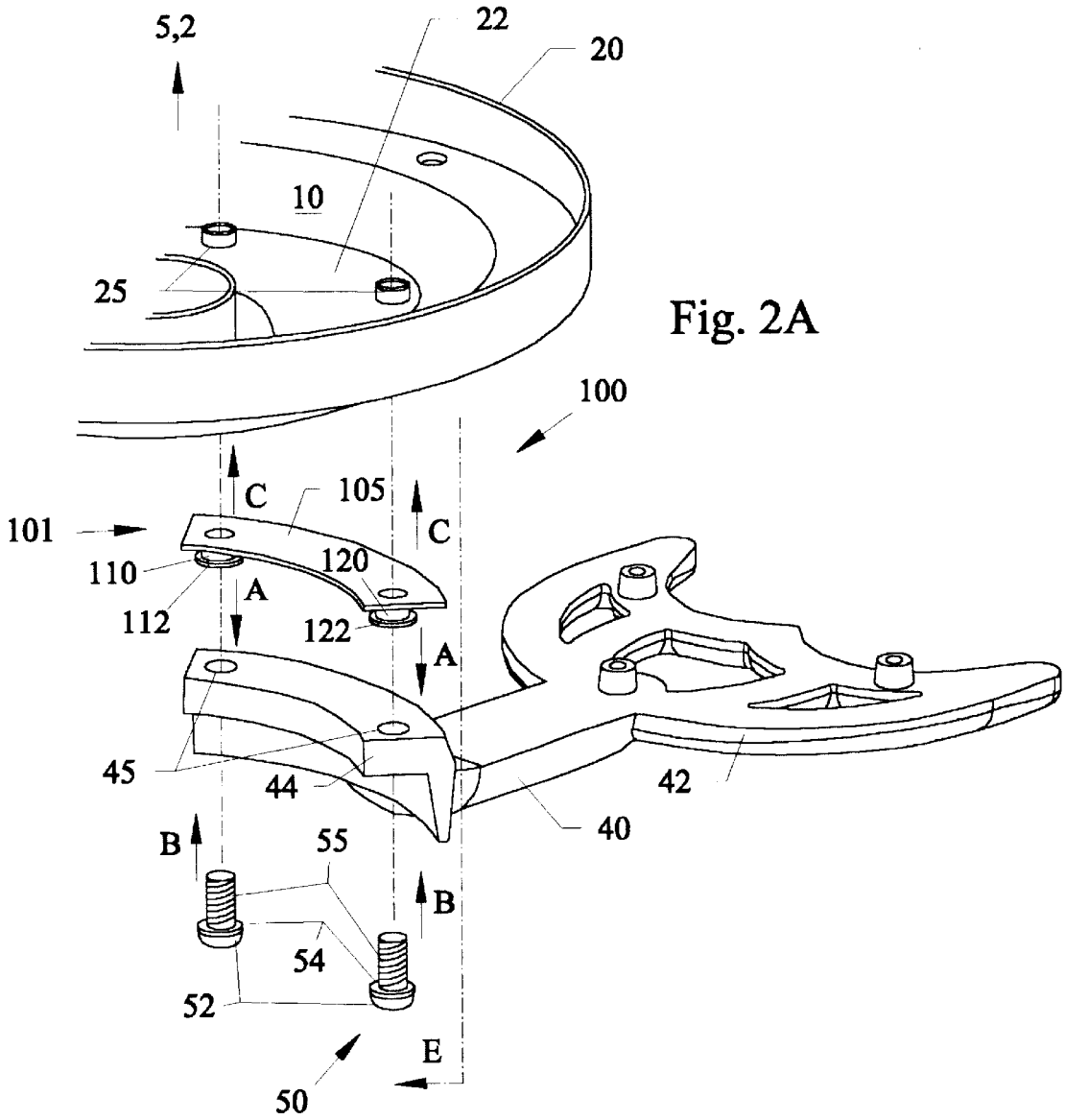
FIG. 2A is a perspective exploded view of a first embodiment of the fasteners, novel grommet washer, with mounting arm and rotor and ceiling fan motor components for the subject invention.

FIG. 2A is a perspective exploded view of a first embodiment 100 of the fasteners 50, novel grommet washer 101, with mounting arm 40 rotor 20 and bottom 22 and ceiling fan motor 10 components for the subject invention. Referring to FIG. 2A, a mounting arm 40 has one end 42 connected to fan blades (not shown here, but shown more clearly in FIG. 1) and a second end 44 having through-holes 45 therethrough. A novel flexible and pliable grommet shaped washer 101 having a longitudinal planar upper portion 105 having a width and length approximately the same as the upper surface width and length of mounting arm end 44. Two hollow cylindrical portions 110 and 120 are located in identical positions as through-holes 45 in mounting arm end 44. Cylindrical portions 110, 120 have respective bottom expanding flange portions 112 and 122. Pliable and flexible grommet shaped washer 101 can be formed from rubber, elastomers, plastics, combinations, thereof, and the like.

Figure 2C:
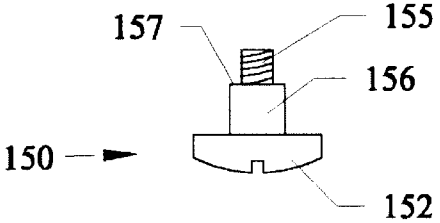
FIG. 2C is perspective view of a novel alternative fastener that can be used with the first embodiment of FIGS. 2A–2B.
Figure 2E:
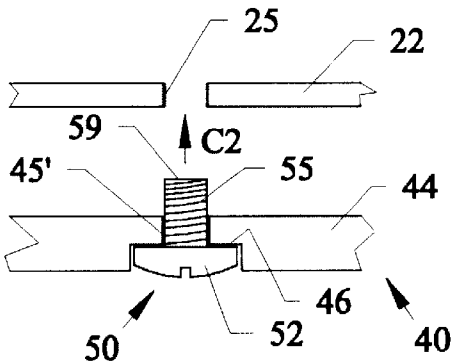
FIG. 2E is another view of FIG. 2B showing another version of a fastener being held captive by being snugly held in place by the inner walls of the through-holes in the mounting arms.
Figure 2B:
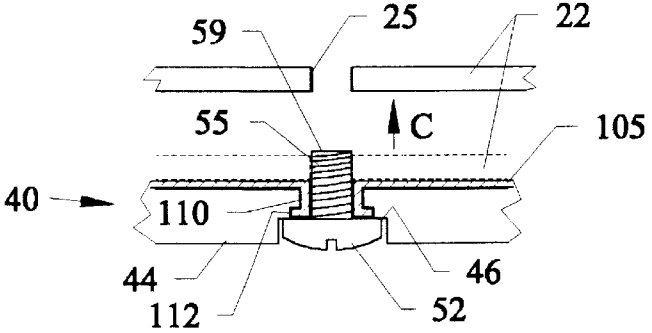
FIG. 2B is a side cross-sectional view of an assembled captive fastener and associated components of FIG. 2A along arrow E being finally assembled.

During assembly of the ceiling fan motor 10, rotating rotor member 20 with bottom endshield 22, has threaded hole openings 25 therein, and housing 5 can usually first be pre-hung from a ceiling 2 in a manner similar to that done in the prior art FIG. 2B is a side cross-sectional view of an assembled captive fastener 50 and associated components of FIG. 2A along arrow E being finally assembled. FIG. 2B shows a single pre-installed (captive) fastener 50 within the cylindrical portion 10 of the novel grommet washer 101 of FIG. 2A. Referring to FIGS. 2A and 2B, the pliable and flexible cylindrical portions 110, 120 of the grommet washer 101 are pushed into the through-holes 45 of the mounting arm 40 in the direction of arrow A, so that the flange portions 112, 122 are on the opposite side of a ledge portion 46 of the mounting arm end 44 thus holding the grommet washer 101 to the mounting arm end 44. Next, the threaded end 55 of fasteners 50 are pushed into the narrow hollow openings in pliable cylindrical portions 110, 120 in the direction of arrow B. The inner diameters of hollow openings 110, 120 can be sized slightly smaller than the exterior diameter of threaded ends 55 thus causing the threaded ends 55 to be held in place with a tip end 59 (only one is shown for clarity) exposed on the upper side of the grommet washer planar portion 105. The regular fasteners 50 that can be used can have heads 52 such as regular head and Philips head screws, bolt heads and the like. Additionally, an extra washer 54 such as those made from steel, rubber, elastomer and the like, can be used with fasteners 50. The grommet washer 101 allows the fasteners 50 to be held captive in the mounting arm 40 prior to attaching the mounting arm 40 to the rotating members 20, 22 of the ceiling mounted motor 10.

Referring to FIGS. 2A, 2B, the final step of installation can have the installer 60 (shown in FIG. 1), in one hand hold the blade 30 connected to mounting arm 40, and guide the tip ends 59 of the fasteners 50 in the direction of arrow C into the mateable threaded openings 25 in bottom endshield 22 of rotating rotor 20 of motor 10. Next the installer can screw the fasteners 50 into the endshield with a driver 70 such as a screw driver. If bolts are used as the fasteners 50, the installer 60 can use a ratchet wrench, and the like. The dotted lines in FIG. 2B represent the final position of the rotating endshield 22 connected to threaded ends 55 of the fastener, so that pliable and flexible planar portion 105 of the grommet washer is compressed and sandwiched between the rotating endshield 22 and the mounting arm 40. Similarly pliable and flexible bottom flange portion 112 of grommet washer 101 is compressed and sandwiched between the fastener head 52 and the mounting arm 40. Thus, the compressed and sandwiched portions 105 and 112 of the grommet washer 101 eliminate vibration noise and movement between the fan motor 10 with rotator 20 bottom endshield 22, and the mounting arm 40 and the fastener(s) 50. Many fan systems use all metal rotors, endshields, fasteners and mounting arms. Using the pliable flexible novel grommet washer 101 eliminates both the inherent vibration noise between the contacting metal components and resulting looseness that can develop when metal vibrating components are directly contacting one another.

Figure 2D:
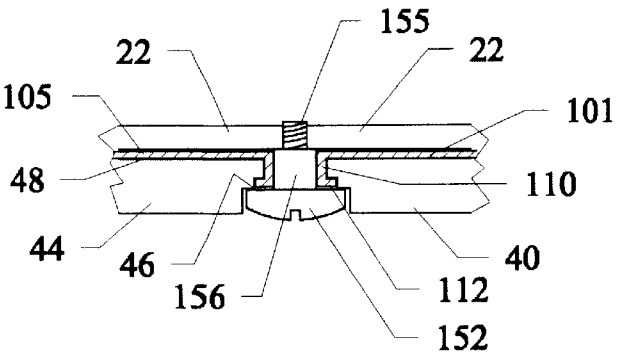
FIG. 2D is a view of FIG. 2B showing the novel alternative fastener connecting the mounting arm to the rotating members and ceiling fan motor using the novel grommet washer.

FIG. 2C is perspective view of a novel alternative fastener that can be used with the first embodiment 100 of FIGS. 2A–2B. FIG. 2D is a view of FIG. 2B showing the novel alternative fastener connecting the mounting arm to the rotating members and ceiling fan motor using the novel grommet washer. Referring to FIGS. 2C and 2D, alternative fastener 150 has an enlarged lower base portion 156 between the threaded shaft end 155 and the fastener head 152. The enlarged lower base portion 156 can allow for a tighter captive fit within cylindrical portion 110 of grommet washer 101. Using enlarged base fasteners allows for all the fasteners 150 being used to attach a mounting arm 40 to the endshield 22 to be tightened such that all upper edges 157 of these fasteners 150 abut against the lower surface of endshield 22. The installer is able to evenly position each of the fasteners 150 between the mounting arm 40 and the endshield 22 and eliminate wobble effects if the mounting arm was unevenly mounted. Additionally, mounting arms 40 can have a second interior ledge portion 48 below the first ledge 46 thus allowing the fastener head 152 to be counter sunk below the bottom exterior surface of the blade arm end 44. The enlarged base portion 156 of the novel fastener 150 causes a partial compression of the inner cylindrical walls of cylindrical portion 110 but still allows the installer to rotate the fastener 150 when doing the final assembly as described above. The resultant configuration shown in FIG. 2D has the upper portion 105, cylindrical portion 110, and bottom flange 112 of the grommet washer 101 all partially compressed allowing a tight and vibration free fit.

FIG. 2E is another view of FIG. 2B showing another version of a fastener 50 being held captive by being snugly held in place by the inner walls 45' of the through-holes in the mounting arms 40. The interior surface walls 45' of the through-holes in the mounting arm can be narrow enough to just be able to hold captive a threaded end 55 of a fastener 50. For example, the interior surface 45' can be tapered, roughened, include protruding portions, and the like, all of which can be part of the same material that makes up the blade mounting arm. Although the preferred mounting blade arms useful with the subject invention embodiments are metal, the mounting blade arms 40 that can be used with this type of captive fastener 50 held in place only by the interior surface of the walls can be made of materials such as but not limited to plastic, wood, and the like. Similar to that described previously, the mounting arm 40 can be guided to a motor endshield threaded receiving opening 25 by the tip 59. The installer can rotate fastener head 52 threading threaded end 55 into receiving opening 25 until head 52 abuts against inner ledge surface 46.

SECOND EMBODIMENT

Figure 3A:
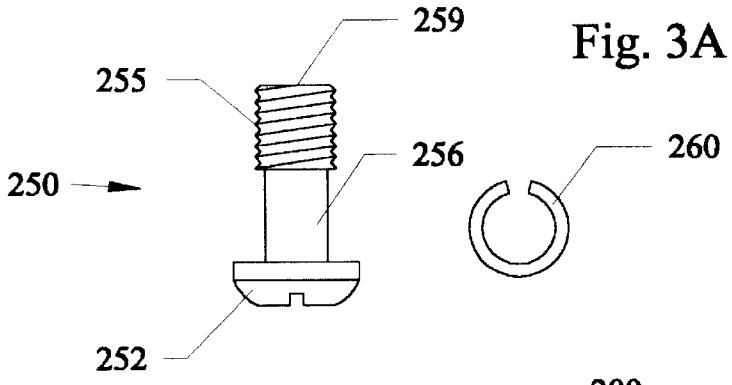
FIG. 3A is a perspective exploded view of a second embodiment of a captive fastener and spring washer within a ceiling fan mounting arm.
Figure 3B:
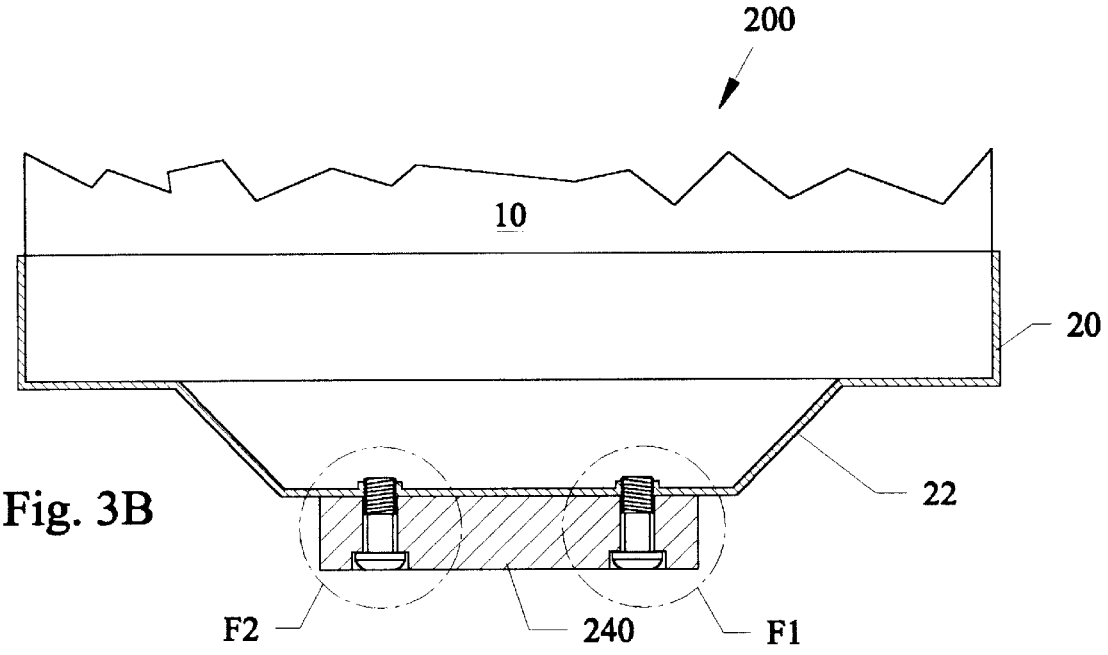
FIG. 3B is a side cross-sectional view of two captive fasteners and spring washers of FIG. 3A being aligned with mateable holes in the motor endshield rotor of FIG. 2A
Figure 3C:
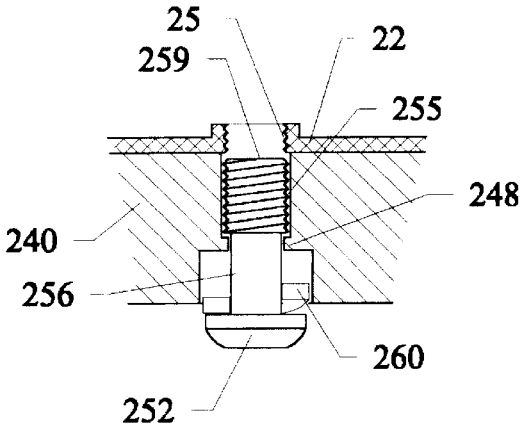
FIG. 3C is an enlarged side view of the unattached captive fastener of FIG. 3B.
Figure 3D:
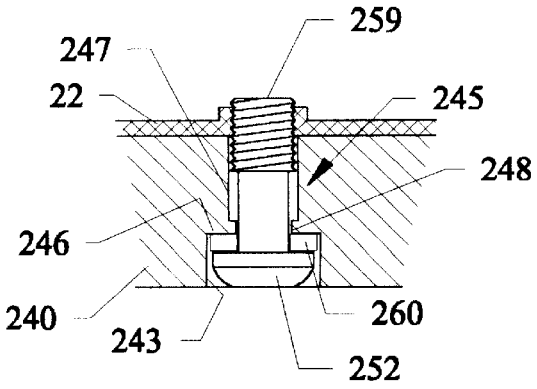
FIG. 3D is an enlarged side view of the attached captive fastener of FIG. 3B.

FIG. 3A is a perspective view of a novel captive fastener 250 with an optional spring locking washer 260 used for the second embodiment 200. FIG. 3B is a side cross-sectional view of a second embodiment 200 of using two of the novel captive fasteners 250 and spring washers 260 of FIG. 3A with a mounting arm 240, rotor 20, and bottom endshield 22 that is connected to a ceiling fan motor 10. FIG. 3C is an enlarged side view of the unattached fastener F1 of FIG. 3B. FIG. 3D is an enlarged side view of the attached fastener F2 of FIG. 3B.

Referring to FIGS. 3A–3D, the fasteners 250 are already held captive in one end of the mounting arm 240 and the opposite end of the mounting arm is already connected to a fan blade (not shown). Fasteners 250 can have a threaded end portion 255 with a diameter larger than a base neck portion 256 and a large head portion 252. The narrow base neck portion 256 between the threaded end 255 and the head 252 allows the fastener 250 to freely float therebetween about ledge 246, 248. The fasteners 250 that can be used can have heads 252 such as regular head and Philips head screws, bolt heads and the like. The blade mounting arm 240 can be similar to the mounting arm 40 of the first embodiment, but with some differences. The through holes 245 in the mounting arm 240 have an upper opening portion 247 with a first diameter sized slightly larger than the diameter of the threaded ends 255 of the novel fasteners 250. Through-holes 245 have an interior facing ledge portion 246 with an internal facing lip portion 248, the latter having a diameter slightly larger than the base neck portion 256 of the fasteners 250. Finally, through-holes 245 have a lower opening portion 243 with a diameter slightly larger than the exterior diameter of the heads 252 of the fasteners 250. An optional spring washer 260 is positioned about the base neck portion 256 and between the ledge/lip 246, 248 and the head 252 of the fastener in order to lock fastener 250 in place. In an unattached position shown in FIG. 3C, the fastener head 252 freely floats to a downward position based on gravity away from the mounting arm 240, and has an end tip 259 slightly protruding upward from an upper surface of the mounting arm 240.

Similar to the first embodiment, the fan motor, rotor 20 and bottom endshield 22 are first hung from a ceiling. Also similar to the first embodiment, the final step of installation for the second embodiment 200 can have the installer 60 (shown in FIG. 1), in one hand hold the blade 30 and pre-connected mounting arm 240, and guide the tip ends 259 of the pre-captive fasteners 250 into the mateable threaded openings 25 in the bottom endshield 22 of rotating rotor 20 of motor 10, and rotate the pre-captive fasteners 250 into the endshield with a driver 70 such as a screw driver. If bolts are used as the fasteners 250, the installer 60 can use a ratchet wrench, and the like. Rotating the fasteners 250 into the endshield threaded holes 25 can compress the optional washer 260 sandwiching the washer 260 between the fastener head 252 and the internal ledge/lip 246, 248, thus locking the fasteners 250 in place.

THIRD EMBODIMENT

Figures 4A, 4B:
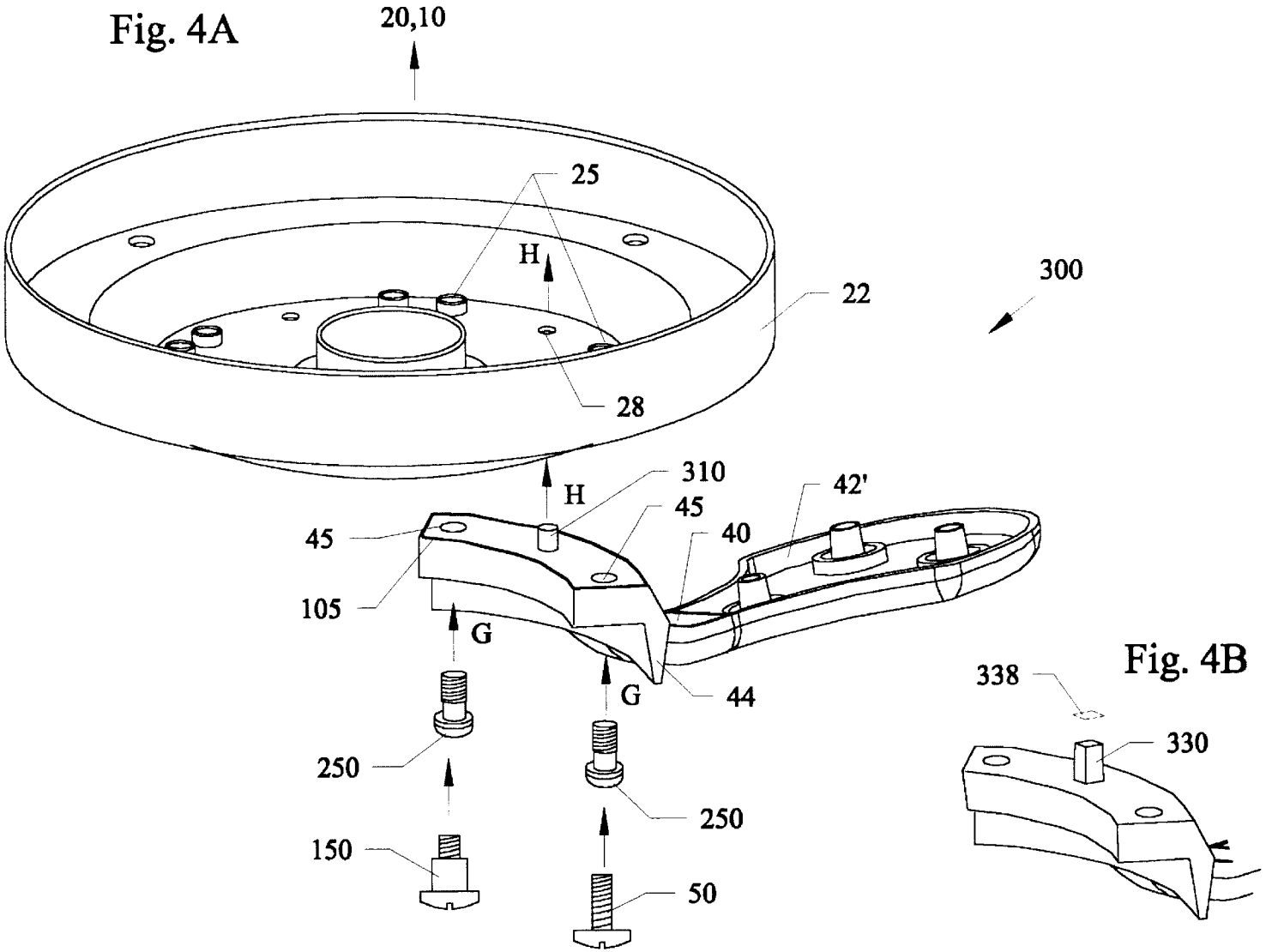
FIG. 4A is a perspective view of a third embodiment of using either or both the captive fastener of the preceding Figures, or conventional fastener with an alignment post for attaching the mounting arm to the a ceiling fan motor.
FIG. 4B shows another version of an alignment post having flat side portions for use with FIG. 4A.

FIG. 4A is a perspective exploded view of a third embodiment 300 of using either or both the captive fasteners 150, 250 of the preceding Figures, or a conventional fastener 50 with an alignment post 310 for attaching the mounting arm 40 to the a ceiling fan motor 10. Referring to FIG. 4A, an alignment post 310 having tapered rounded sides with a narrow tip portion and an expanding bottom portion is located approximately half way between through-holes 45 in end 44 of blade mounting arm 40. Opposite end 42' of blade arm 40 has attachment points similar to those previously described. An opening 28 having a diameter the same as or slightly smaller than the diameter of the base portion of post 310 is located in the bottom of motor endshield 22.

Similar to that previously described, bottom endshield 22 is attached to a rotating rotor 20 which is attached to a ceiling mounted motor 10. Next as previously described, captive fasteners 250, 150 with or without rubber grommet washer 101 have their threaded ends moved in the direction of arrow G into through-holes 45 and are held captive therein. Next, the mounting arm 40 can be raised so that alignment post 310 is moved upward in the direction of arrow H into opening 28, where the tapered sides of post 310 cause a snug fit when pushed upward as far as possible into opening 28. Next fasteners 250, 150 are rotated and tightened into receiving threaded openings 25 in endshield 22. Alternatively, a conventional fastener 50 such as but not limited to a regular head screw, Philips head screw and bolt can be used with or without grommet washer 101.

FIG. 4B shows an alternative version of an alignment post 330 having flat side portions such as but not limited to a square, rectangle, hexagon, triangle and the like, along with a similarly configured opening 338 for the endshield 22 all for use with FIG. 4A. Utilizing a non round alignment post 330 further forces the mounting arm 40 to be properly aligned in position beneath endshield 22. Additionally non round alignment post can be tapered as well.

Figure 4C:
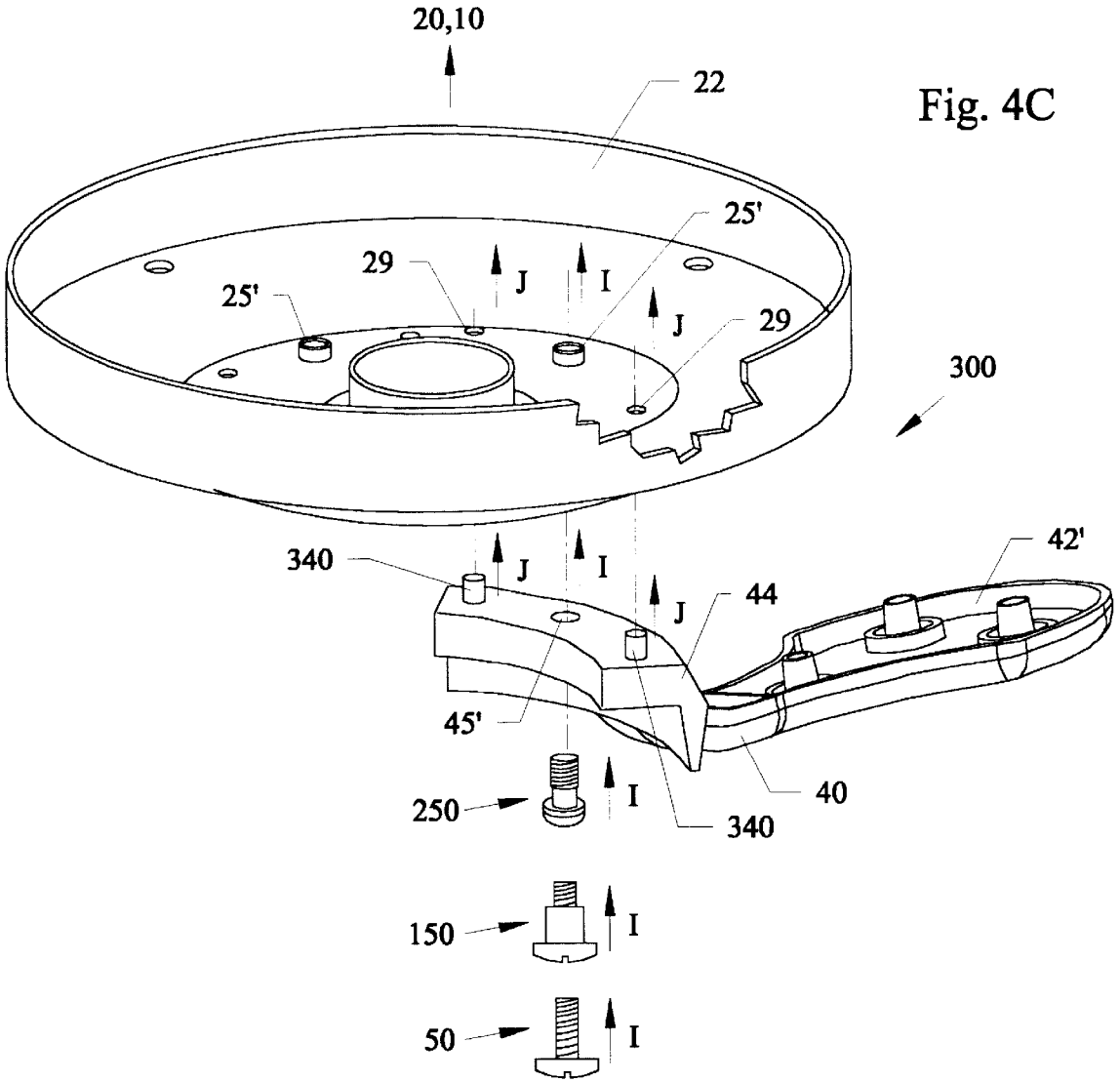
FIG. 4C is a perspective view of the third embodiment of FIG. 4A using two alignment posts which allows for only one captive or one conventional fastener to hold the mounting arm to the motor.

FIG. 4C is a perspective view of the third embodiment 300 of FIG. 4A using two alignment posts 340 which allows for only one captive 150, 250 or one conventional fastener 50 to hold the mounting arm 40 to the motor 10. Referring to FIG. 4C, dual alignment posts 340 having similar shapes to those previously described above can be located opposite one another on end 44 of blade mounting arm 40. Approximately halfway between can be a single through-hole 45'. Opposite end 42' of blade arm 40 has attachment points similar to those previously described. Dual openings 29 having a diameter the same as or slightly smaller than the diameter of the base portion of posts 340 are located in the bottom of motor endshield 22 on both sides of threaded receiving holes 25'.

Similar to that previously described, bottom endshield 22 of rotating rotor 20 are attached to a ceiling mounted motor 10. Next as previously described, a single captive fastener (250, 150 with or without rubber grommet washer 101) has its' threaded end moved in the direction of arrow I into through-hole 45' and is held captive therein. Next, the mounting arm 40 can be raised so that dual alignment posts 340 are moved upward in the direction of arrow J into openings 29, where the tapered sides of posts 340 cause a snug fit when pushed upward as far as possible into openings 29. Next the captive fastener 250, 150 is rotated and tightened into receiving threaded opening 25' in endshield 22. Alternatively, a single conventional fastener 50 such as but not limited to a regular head screw, Philips head screw and bolt can be used with or without grommet washer 101.

The alignment posts can also allow the mounting arm to be evenly attached to the motor endshield and effectively eliminate wobbling effects when the ceiling fan is running.

While FIGS. 4A–4C show only one and two alignment posts, the invention can be practiced with three or more alignment posts as well.

Although the preferred embodiment describes the alignment post extending upward from the mounting arm with a mateable opening on the rotating member portion of the fan motor, the invention can be practiced with the alignment post(s) extending downward from the rotating member of the motor with the mateable opening on the mounting arm.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A device for attaching ceiling fan mounting arms to ceiling fan motors using pre-installed captive fasteners on the mounting arms, comprising in combination:

a ceiling fan motor having a rotating member;

a fan blade;

a mounting arm having a first end connected to the fan blade and a second end having a fastener held captive therein, the captive fastener having a threaded end; and means for threading the threaded end of the captive fastener into a mateable opening on the rotating member.

2. The device for attaching the ceiling fan mounting arms of claim 1, wherein the captive fastener includes:

a deformable means pre-installed within an opening in the second end of the mounting arm, and a portion of the fastener held within the opening by the deformable means.

3. The device for attaching the ceiling fan mounting arms of claim 2, wherein the fastener includes:

a head and a shaft, the shaft having a threaded tip end and an enlarged base between the tip end and the head of the screw.

4. The device for attaching the ceiling fan mounting arms of claim 2, wherein the deformable means includes:

a grommet having a first portion sandwiched between a bottom of the mounting arm and a second portion sandwiched between the rotating member and a top of the mounting arm.

5. The device for attaching the ceiling fan mounting arms of claim 3, wherein the deformable means includes:

a grommet having a first portion sandwiched between a bottom of the mounting arm and a second portion sandwiched between the rotating member and a top of the mounting arm.

6. The device for attaching the ceiling fan mounting arms of claim 1, wherein the captive fastener includes:

a narrow neck portion that allows the fastener to move freely about both sides of an internal ledge located in a through-hole in the mounting arm.

7. The device for attaching the ceiling fan mounting arms of claim 1, wherein the captive fastener further includes:

a head of the fastener to a first side of a ledge in a through-hole within the mounting arm, and the threaded end of the fastener to a second side of the ledge, wherein the captive fastener can move freely within a selected space.

8. The device for attaching the ceiling fan mounting arms of claim 7, wherein the captive fastener further includes:

the threaded end of the fastener having a larger diameter than a neck portion of the fastener, the neck portion being located between the fastener head and the threaded end, and the threaded end being positioned on a second surface of the ledge opposite the first surface, wherein the neck portion is free to move about the ledge.

9. The device for attaching the ceiling fan mounting arms of claim 6, wherein the captive fastener further includes:

a tip portion protruding through an upper side of the mounting arm for guiding the mounting arm to the mateable opening on the rotating member.

10. The device for attaching the ceiling fan mounting arms of claim 1, further comprising:

an alignment member and a mateable opening for receiving the alignment member, and for allowing the mounting arm to be correctly aligned in position on to the rotating member.

11. The device for attaching the ceiling fan mounting arms of claim 1, wherein the member has tapered sides.

12. The device for attaching the ceiling fan mounting arms of claim 11, wherein the member has rounded sides.

13. The device for attaching the ceiling fan mounting arms of claim 11, wherein the member has flat side portions.

14. The device for attaching the ceiling fan mounting arms of claim 11, further comprising:

a second alignment member and a second mateable opening for receiving the second alignment member and for allowing the mounting arm to be correctly aligned in position on to the rotating member.

15. A method for attaching fan blade arms having captive fasteners to ceiling mounted motors, comprising the steps of:

attaching a ceiling fan motor to a ceiling;

holding a fastener having a threaded end captive in a through-hole in one end of a fan blade mounting arm;

positioning the threaded end of the captive fastener into a mateable receiving threaded opening on the ceiling fan motor; and rotating the threaded end of the fastener into the mateable receiving opening on the ceiling fan, wherein the blade mounting arm is attached to the ceiling fan motor without having to use any loose noncaptive fasteners.

16. A device for aligning ceiling fan mounting arms to ceiling fan motors, comprising in combination:

a ceiling fan motor having a rotating member;

a fan blade;

a mounting arm having a first end connected to the fan blade and a second end having a fastener therein with a threaded end;

an alignment member and a mateable opening for aligning the second end of the mounting arm to the rotating member of the ceiling fan motor; and means for threading the threaded end of the fastener into a mateable threaded opening on the rotating member.

17. The device for aligning the ceiling fan mounting arms of claim 16, wherein the fastener is chosen from one of: a bolt, a regular head screw, and a Phillips head screw.

18. The device for attaching the ceiling fan mounting arms of claim 16, wherein the alignment member has rounded sides.

19. The device for attaching the ceiling fan mounting arms of claim 16, wherein the alignment member has flat side portions.

20. The device for attaching the ceiling fan mounting arms of claim 16, further comprising:

a second alignment member and a second mateable opening, for aligning the second end of the mounting arm to the rotating member of the ceiling fan motor.

* * * * *